US008317293B2

(12) United States Patent
Lill et al.

(10) Patent No.: US 8,317,293 B2
(45) Date of Patent: Nov. 27, 2012

(54) COLOR CONSISTENCY FOR A MULTI-PRINTHEAD SYSTEM

(75) Inventors: Joseph E. Lill, Waynesville, OH (US); Terry A. Wozniak, Springfield, OH (US); Joseph P. Mangan, Dayton, OH (US); Robert J. Simon, Bellbrook, OH (US)

(73) Assignee: Eastman Kodak Company, Rochester, NY (US)

( * ) Notice: Subject to any disclaimer, the term of this patent is extended or adjusted under 35 U.S.C. 154(b) by 259 days.

(21) Appl. No.: 12/796,729

(22) Filed: Jun. 9, 2010

(65) Prior Publication Data

US 2011/0304668 A1 Dec. 15, 2011

(51) Int. Cl.
*B41J 29/393* (2006.01)

(52) U.S. Cl. ..... 347/19

(58) Field of Classification Search ..... 347/14, 347/15, 19, 75–77
See application file for complete search history.

(56) References Cited

U.S. PATENT DOCUMENTS 4,068,241 A 1/1978 Yamada
4,636,808 A 1/1987 Herron
6,079,821 A 6/2000 Chwalek et al.
6,457,807 B1 10/2002 Hawkins et al.
6,491,362 B1 12/2002 Jeanmarie
6,505,921 B2 1/2003 Chwalek et al.
6,532,026 B2 * 3/2003 Takahashi et al. ..... 347/41
6,554,410 B2 4/2003 Jeanmarie et al.
6,575,566 B1 6/2003 Jeanmarie et al.
6,588,888 B2 7/2003 Jeanmarie et al.
6,793,328 B2 9/2004 Jeanmarie et al.
6,827,429 B2 12/2004 Jeanmarie et al.
6,851,796 B2 2/2005 Jeanmarie et al.
7,273,272 B2 9/2007 Inoue

* cited by examiner

*Primary Examiner* — An Do
(74) *Attorney, Agent, or Firm* — Nelson Adrian Blish

(57) ABSTRACT

A printing system using multiple printheads maintains color consistency between the printheads by printing a first color patch (102) with a first color with a plurality of printheads (30) at a first pressure and with a first pixel fill coverage. A second color patch (104) is printed with the first color with the plurality of printheads at a second pressure with the first pixel fill coverage. The print density of the first patch and the second patch is measured for each of the plurality of printheads and the print density for each of the plurality of printheads is compared. A pressure for each of the plurality of printheads is adjusted to compensate for differences in density between the first patch and the second patch for each of the printheads.

14 Claims, 6 Drawing Sheets

COLOR CONSISTENCY FOR A MULTI-PRINTHEAD SYSTEM

CROSS REFERENCE TO RELATED APPLICATIONS

Reference is made to commonly-assigned copending U.S. patent application Ser. No. 12/796,715 (now U.S. Publication No. 2011/0304667), filed Jun. 9, 2010, entitled COLOR CONSISTENCY FOR A MULTI-PRINTHEAD SYSTEM, by Lill et al., the disclosure of which is incorporated herein.

FIELD OF THE INVENTION

This invention relates generally to continuous printing systems in which a liquid stream breaks into droplets, and in particular to a method of insuring color consistency for a multi-printhead system.

BACKGROUND OF THE INVENTION

Printing systems that deflect drops using a gas flow are known, see, for example, U.S. Pat. No. 4,068,241 (Yamada). When using a system with multiple printheads, however, it is important that colors for each of the printheads be consistent. This consistency must be both within a run and from run-to-run.

When printing with multiple printheads a number of parameters come into play which affects the darkness or optical density of the print from each printhead. Some of these factors may be the shape and diameter for the nozzle of each printhead, ink pressure, drop creation frequency, printing speed, and the concentration of the ink. Various attempts have been made to solve this problem. For example, U.S. Pat. No. 7,273,272 (Inoue) inserts a device into the flow path for altering resistance to the flow of ink.

SUMMARY OF THE INVENTION

Briefly, according to one aspect of the present invention a first color patch is printed with a first color with a plurality of printheads at a first pressure and with a first pixel fill coverage. A second color patch is printed with the first color with the plurality of printheads at a second pressure with the first pixel fill coverage. The print density of the first patch and the second patch is measured for each of the plurality of printheads and the print density for each of the plurality of printheads is compared. A pressure for each of the plurality of printheads is adjusted to compensate for differences in density between each of the printheads.

The invention and its objects and advantages will become more apparent in the detailed description of the preferred embodiment presented below.

BRIEF DESCRIPTION OF THE DRAWINGS

In the detailed description of the example embodiments of the invention presented below, reference is made to the accompanying drawings, in which.

DETAILED DESCRIPTION OF THE INVENTION

Figure 1:
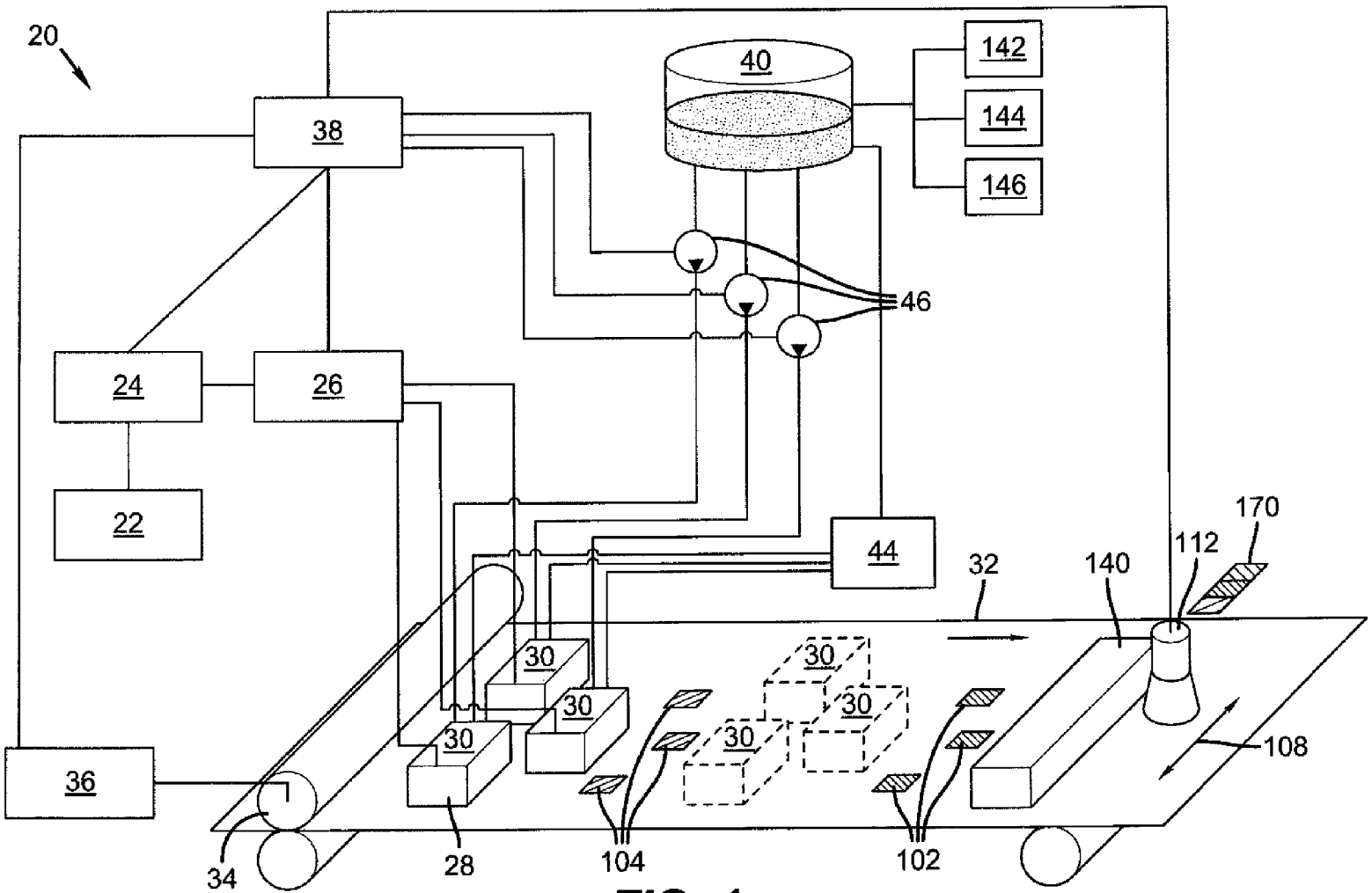
FIG. 1 shows a simplified schematic block diagram of an example embodiment of a printing system made in accordance with the present invention.

The present description will be directed in particular to elements forming part of, or cooperating more directly with, apparatus in accordance with the present invention. It is to be understood that elements not specifically shown or described may take various forms well known to those skilled in the art. In the following description and drawings, identical reference numerals have been used, where possible, to designate identical elements.

The example embodiments of the present invention are illustrated schematically and not to scale for the sake of clarity. One of the ordinary skills in the art will be able to readily determine the specific size and interconnections of the elements of the example embodiments of the present invention.

As described herein, the example embodiments of the present invention provide a printhead or printhead components typically used in inkjet printing systems. However, many other applications are emerging which use inkjet printheads to emit liquids (other than inks) that need to be finely metered and deposited with high spatial precision. As such, as described herein, the terms "liquid" and "ink" refer to any material that can be ejected by the printhead or printhead components described below.

Figure 2:
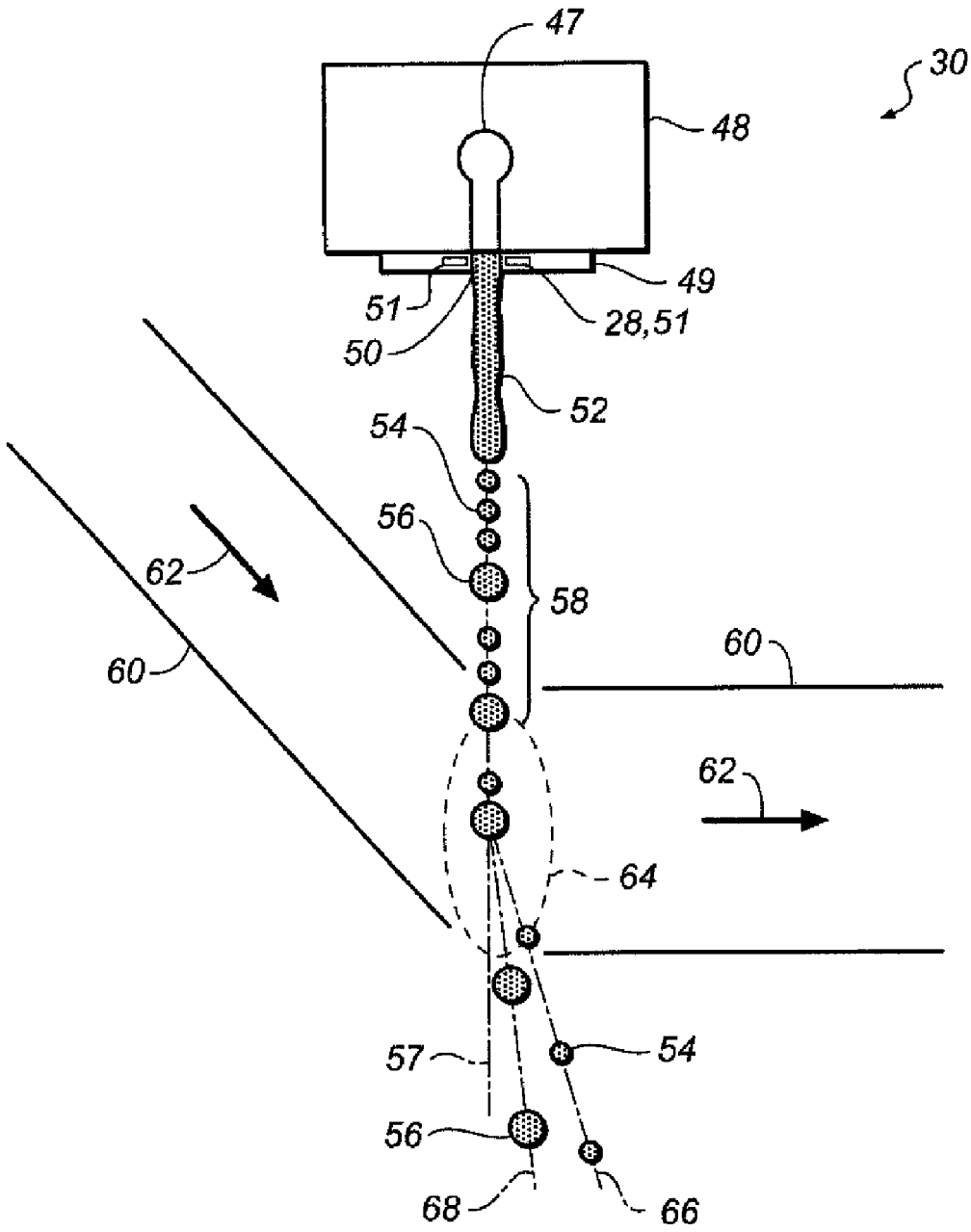
FIG. 2 is a schematic view of an example embodiment of a continuous printhead made in accordance with the present invention.
Figure 3:
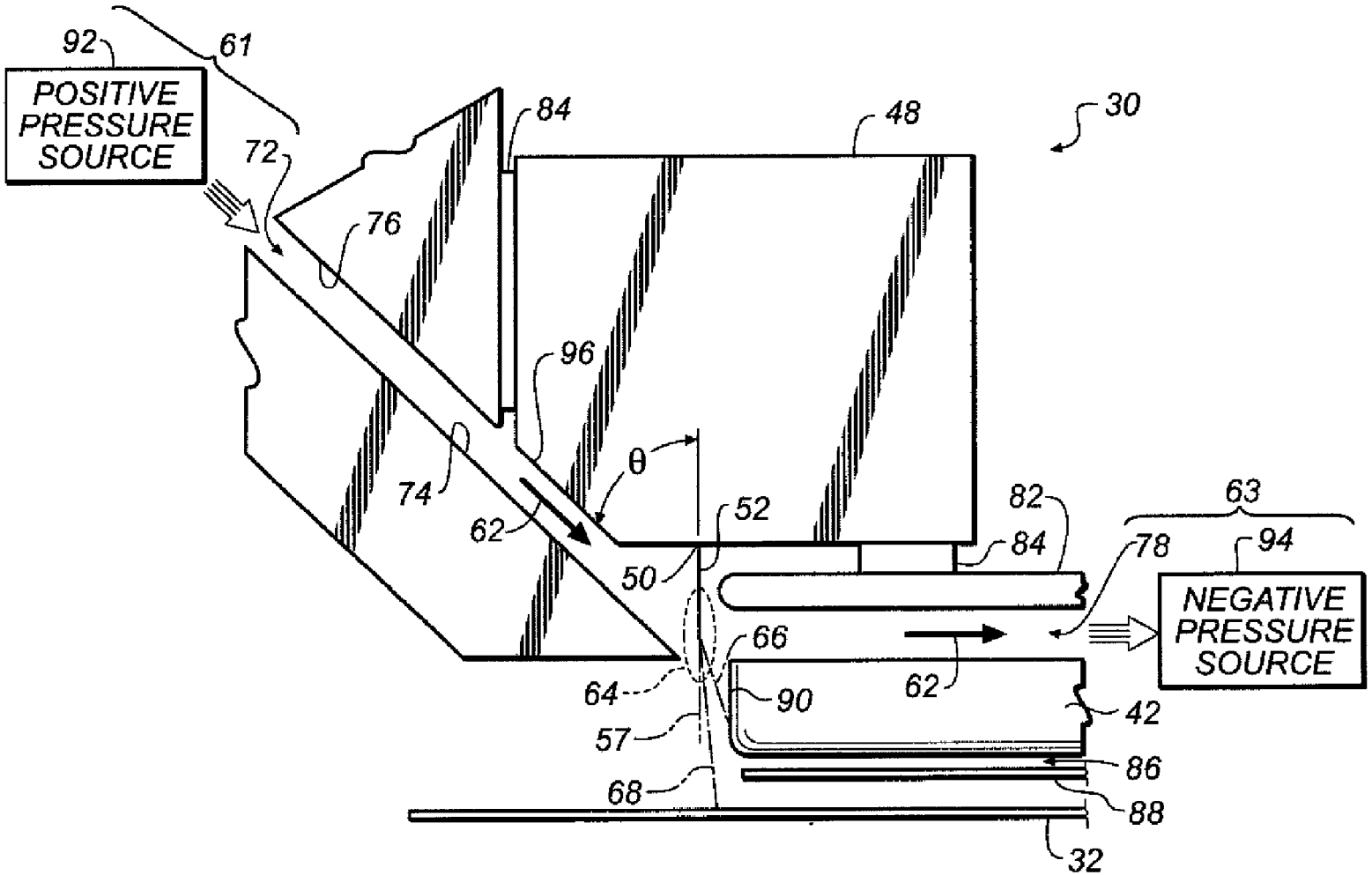
FIG. 3 is a schematic view of an example embodiment of a continuous printhead made in accordance with the present invention.

Referring to FIGS. 1-3, example embodiments of a printing system and a continuous printhead are shown that include the present invention described below. It is contemplated that the present invention will also find application in other types of printheads or jetting modules including, for example, drop on demand printheads and other types of continuous printheads.

Referring to FIG. 1, a continuous printing system 20 includes an image source 22 such as a scanner or computer which provides raster image data, outline image data in the form of a page description language, or other forms of digital image data. This image data is converted to half-toned bitmap image data by an image processing unit 24 which also stores the image data in memory. A plurality of drop forming mechanism control circuits 26 read data from the image memory and apply time-varying electrical pulses to a drop forming mechanism(s) 28 that are associated with one or more nozzles of one or more printheads 30. These pulses are applied at an appropriate time, and to the appropriate nozzle, so that drops formed from a continuous inkjet stream will form spots on a recording medium 32 in the appropriate position designated by the data in the image memory.

Recording medium 32 is moved relative to printhead 30 by a recording medium transport system 34, which is electronically controlled by a recording medium transport control system 36, and which in turn is controlled by a micro-controller 38. The recording medium transport system shown in FIG. 1 is a schematic only, and many different mechanical configurations are possible. For example, a transfer roller could be used as recording medium transport system 34 to facilitate transfer of the ink drops to recording medium 32. Such transfer roller technology is well known in the art. In the case of page width printheads, it is most convenient to move recording medium 32 past a stationary printhead. For page wide printing applications it is common to employ a plurality of printheads 30, rather than a single printhead to print across the width of the recording medium. The printheads typically are positioned relative to each other so that print swaths from each of the printheads are stitched together to form single print region spanning the recording medium. While a group of three printheads 30 are shown to cover the print region in the FIG. 1, other numbers of printheads can be employed. The number of printheads used depends of the print width of each printhead and the desired print width. However, in the case of scanning print systems, it is usually most convenient to move the printhead along one axis (the sub-scanning direction) and the recording medium along an orthogonal axis (the main scanning direction) in a relative raster motion. In some printing systems, it is desirable to print with more than one color of ink. In such systems, additional groups of printheads are typically used for each additional ink color. One such additional group of three printheads is denoted by the dashed line printheads 30. A similar reservoir, pressure regulators, and recycling unit would be used to supply and retrieve ink from the additional group of printheads. As their structure and operation is the same as those used for the first group of printheads, they have been omitted from the FIG. 1 for drawing clarity.

Ink contained in an ink reservoir 40 is supplied under sufficient pressure to the printheads 30 to cause continuous streams of ink to flow from each of the nozzles of the printheads 30. In the non-printing state, continuous inkjet drop streams are unable to reach recording medium 32 due to an ink catcher 42 (see FIG. 3) that blocks the stream and which may allow a portion of the ink to be recycled by an ink recycling unit 44. The ink recycling unit reconditions the ink and feeds it back to reservoir 40. Such ink recycling units are well known in the art. The ink pressure suitable for optimal operation will depend on a number of factors, including geometry and thermal properties of the nozzles and thermal properties of the ink. A constant ink pressure can be achieved by applying pressure to ink reservoir 40 under the control of ink pressure regulator 46. Alternatively, the ink reservoir can be left unpressurized, or even under a reduced pressure (vacuum), and a pump is employed to deliver ink from the ink reservoir under pressure to the printhead 30. In such an embodiment, the ink pressure regulator 46 can comprise an ink pump control system. In multi-printhead systems, it is common for independent ink pressure regulators 46 to be used for each of the printheads 30.

The ink is distributed to printhead 30 through an ink channel 47, shown in FIG. 2. The ink preferably flows through slots or holes etched through a silicon substrate of printhead 30 to its front surface, where a plurality of nozzles and drop forming mechanisms, for example, heaters, are situated. When printhead 30 is fabricated from silicon, drop forming mechanism control circuits 26 can be integrated with the printhead. Printhead 30 also includes a deflection mechanism (not shown in FIG. 1) which is described in more detail below with reference to FIGS. 2 and 3.

Referring to FIG. 2, a schematic view of continuous liquid printhead 30 is shown. A jetting module 48 of printhead 30 includes an array or a plurality of nozzles 50 formed in a nozzle plate 49. In FIG. 2, nozzle plate 49 is affixed to jetting module 48. However, as shown in FIG. 3, nozzle plate can be an integral portion of the jetting module 48.

Liquid, for example, ink, is emitted under pressure through each nozzle 50 of the array to form filaments of liquid 52. In FIG. 2, the array or plurality of nozzles extends into and out of the figure.

Jetting module 48 is operable to form liquid drops having a first size or volume and liquid drops having a second size or volume through each nozzle. To accomplish this, jetting module 48 includes a drop stimulation or drop forming device 28, for example, a heater or a piezoelectric actuator, that, when selectively activated, perturbs each filament of liquid 52, for example, ink, to induce portions of each filament to break off from the filament and coalesce to form drops 54, 56.

In FIG. 2, drop forming device 28 is a heater 51, for example, an asymmetric heater or a ring heater (either segmented or not segmented), located in a nozzle plate 49 on one or both sides of nozzle 50. This type of drop formation is known and has been described in, for example, U.S. Pat. No. 6,457,807 (Hawkins et al.); U.S. Pat. No. 6,491,362 B1 (Jeanmaire); U.S. Pat. No. 6,505,921 (Chwalek et al.); U.S. Pat. Nos. 6,554,410; 6,575,566; 6,588,888; 6,793,328; 6,827,429; and 6,851,796 (all to Jeanmaire et al.).

Typically, one drop forming device 28 is associated with each nozzle 50 of the nozzle array. However, a drop forming device 28 can be associated with groups of nozzles 50 or all of nozzles 50 of the nozzle array.

When printhead 30 is in operation, drops 54, 56 are typically created in a plurality of sizes or volumes, for example, in the form of large drops 56, a first size or volume, and small drops 54, a second size or volume. The ratio of the mass of the large drops 56 to the mass of the small drops 54 is typically approximately an integer between 2 and 10. A drop stream 58 including drops 54 and 56, and follows a drop path or trajectory 57. Drops of the small size are created by application of drop formation pulses to the liquid stream issuing from a nozzle at a base drop formation frequency.

Printhead 30 also includes a gas flow deflection mechanism 60 that directs a flow of gas 62, for example, air, past a portion of the drop trajectory 57. This portion of the drop trajectory is called the deflection zone 64. As the flow of gas 62 interacts with drops 54, 56 in deflection zone 64 it alters the drop trajectories. As the drop trajectories pass out of the deflection zone 64 they are traveling at an angle, called a deflection angle, relative to the undeflected drop trajectory 57.

Small drops 54 are more affected by the flow of gas than are large drops 56 so that the small drop trajectory 66 diverges from the large drop trajectory 68. That is, the deflection angle for small drops 54 is larger than for large drops 56. The flow of gas 62 provides sufficient drop deflection and therefore sufficient divergence of the small and large drop trajectories so that catcher 42 (shown in FIGS. 1 and 3) can be positioned to intercept one of the small drop trajectory 66 and the large drop trajectory 68 so that drops following the trajectory are collected by catcher 42, while drops following the other trajectory 57 bypass the catcher and impinge a recording medium 32 (shown in FIGS. 1 and 3).

When catcher 42 is positioned to intercept large drop trajectory 68, small drops 54 are deflected sufficiently to avoid contact with catcher 42 and strike the recording medium. As the small drops are printed, this is called small drop print mode. When catcher 42 is positioned to intercept small drop trajectory 66, large drops 56 are the drops that print. This is referred to as large drop print mode.

Referring to FIG. 3, jetting module 48 includes an array or a plurality of nozzles 50. Liquid, for example, ink, supplied through channel 47, shown in FIG. 2, is emitted under pressure through each nozzle 50 of the array to form filaments of liquid 52. In FIG. 3, the array or plurality of nozzles 50 extends into and out of the figure.

Drop stimulation or drop forming device 28 (shown in FIGS. 1 and 2) associated with jetting module 48 is selectively actuated to perturb the filament of liquid 52 to induce portions of the filament to break off from the filament to form drops. In this way, drops are selectively created in the form of large drops and small drops that travel toward a recording medium 32.

Positive pressure gas flow structure 61 of gas flow deflection mechanism 60 is located on a first side of drop trajectory 57. Positive pressure gas flow structure 61 includes first gas flow duct 72 that includes a lower wall 74 and an upper wall 76. Gas flow duct 72 directs gas flow 62 supplied from a positive pressure source 92 at downward angle θ of approximately a 45° relative to liquid filament 52 toward drop deflection zone 64 (also shown in FIG. 2). An optional seal(s) 84 provides an air seal between jetting module 48 and upper wall 76 of gas flow duct 72.

Upper wall 76 of gas flow duct 72 does not need to extend to drop deflection zone 64 (as shown in FIG. 2). In FIG. 3, upper wall 76 ends at a wall 96 of jetting module 48. Wall 96 of jetting module 48 serves as a portion of upper wall 76 ending at drop deflection zone 64.

Negative pressure gas flow structure 63 of gas flow deflection mechanism 60 is located on a second side of drop trajectory 57. Negative pressure gas flow structure includes a second gas flow duct 78 located between catcher 42 and an upper wall 82 that exhausts gas flow from deflection zone 64. Second gas flow duct 78 is connected to a negative pressure source 94 that is used to help remove gas flowing through second gas flow duct 78. An optional seal(s) 84 provides an air seal between jetting module 48 and upper wall 82.

As shown in FIG. 3, gas flow deflection mechanism 60 includes positive pressure source 92 and negative pressure source 94. However, depending on the specific application contemplated, gas flow deflection mechanism 60 can include only one of positive pressure source 92 and negative pressure source 94.

Gas supplied by first gas flow duct 72 is directed into the drop deflection zone 64, where it causes large drops 56 to follow large drop trajectory 68 and small drops 54 to follow small drop trajectory 66. As shown in FIG. 3, small drop trajectory 66 is intercepted by a front face 90 of catcher 42. Small drops 54 contact face 90 and flow down face 90 and into a liquid return duct 86 located or formed between catcher 42 and a plate 88. Collected liquid is either recycled and returned to ink reservoir 40 (shown in FIG. 1) for reuse or discarded. Large drops 56 bypass catcher 42 and travel on to recording medium 32. Alternatively, catcher 42 can be positioned to intercept large drop trajectory 68. Large drops 56 contact catcher 42 and flow into a liquid return duct located or formed in catcher 42. Collected liquid is either recycled for reuse or discarded. Small drops 54 bypass catcher 42 and travel on to recording medium 32. While the catcher shown in FIG. 3 is a Coanda type catcher, other catcher types can be used, such as a knife edge catcher.

Alternatively, deflection can be accomplished by applying heat asymmetrically to filament of liquid 52 using an asymmetric heater 51. When used in this capacity, asymmetric heater 51 typically operates as the drop forming mechanism in addition to the deflection mechanism. This type of drop formation and deflection is known having been described in, for example, U.S. Pat. No. 6,079,821 (Chwalek et al.).

Deflection can also be accomplished using an electrostatic deflection mechanism. Typically, the electrostatic deflection mechanism either incorporates drop charging and drop deflection in a single electrode, like the one described in U.S. Pat. No. 4,636,808 (Herron), or includes separate drop charging and drop deflection electrodes.

As shown in FIG. 3, catcher 42 is a type of catcher commonly referred to as a "Coanda" catcher. However, the "knife edge" catcher shown in FIG. 1 and the "Coanda" catcher shown in FIG. 3 are interchangeable and either can be used usually the selection depending on the application contemplated. Alternatively, catcher 42 can be of any suitable design including, but not limited to, a porous face catcher, a delimited edge catcher, or combinations of any of those described above.

Continuous stream inkjet printing uses a pressurized ink source which produces a continuous stream of ink droplets. Stimulation devices, such as heaters positioned around the nozzle, stimulate the stream to break up into drops with either relatively large volumes or relatively small volumes. These drops are then directed by one of several means, including electrostatic deflection or gas flow deflection. Printheads utilizing gas flow for deflection are known and have been described.

In continuous inkjet printing, a pressurized ink source is used to eject a filament of fluid through a nozzle bore from which a continuous stream of ink drops are formed using a drop forming device. Drop forming devices, also called stimulation devices, such as heaters positioned around the nozzle, stimulate the stream to break up into drops. The ink drops are directed to an appropriate location using one of several methods (electrostatic deflection, heat deflection, gas deflection, etc.). When no print is desired, the ink drops are deflected into an ink capturing mechanism (catcher, interceptor, gutter, etc.) and either recycled or disposed of. When print is desired, the ink drops are not deflected and allowed to strike a recording medium. Alternatively, deflected ink drops can be allowed to strike the recording medium, while non-deflected ink drops are collected in the ink capturing mechanism.

In a printing system using multiple printheads it is important to maintain print density consistency between the printheads. The print density produced by a printhead is affected by the optical density of the ink, the properties of the recording medium, by the volume of the ink drops and also by the pixel fill coverage used. The volume of the ink drops depends on the base drop formation frequency, the ink pressure, and the flow characteristics of each printhead. Using the same ink reservoir to supply ink for all printhead, ensures that the ink properties are matched for all the printheads. Typically all printheads in the printing system operate at the same base drop formation frequency as this simplifies the processing and transfer of the print data to the printheads. The only remaining sources of print density variation from printhead to printhead are ink pressure differences and variations in the flow characteristics. The invention provides the means to eliminate these final sources of print density variation.

Figure 4:
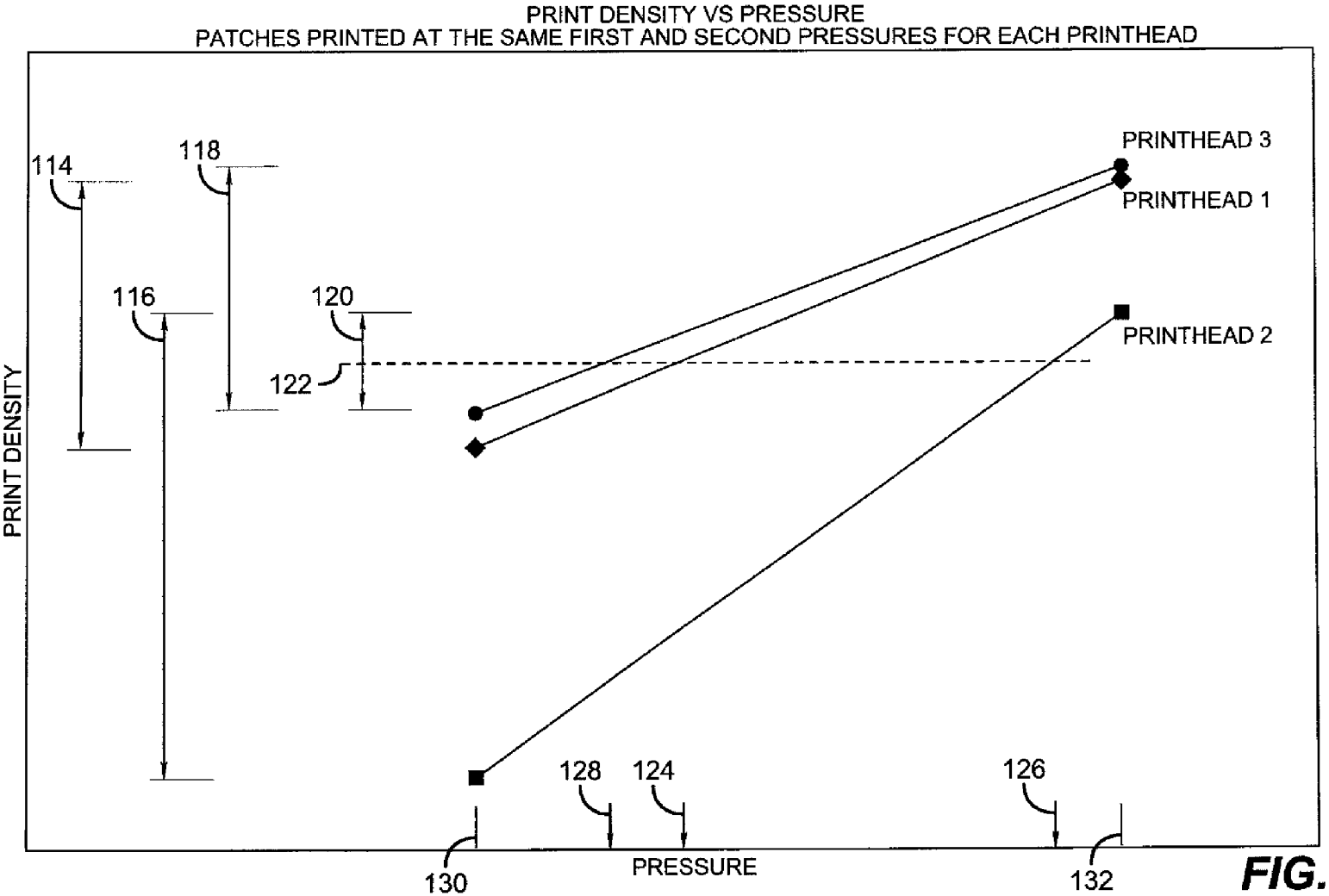
FIG. 4 is a graph of print density versus pressure for patches printed at the same first and second pressure for each printhead.
Figure 5:
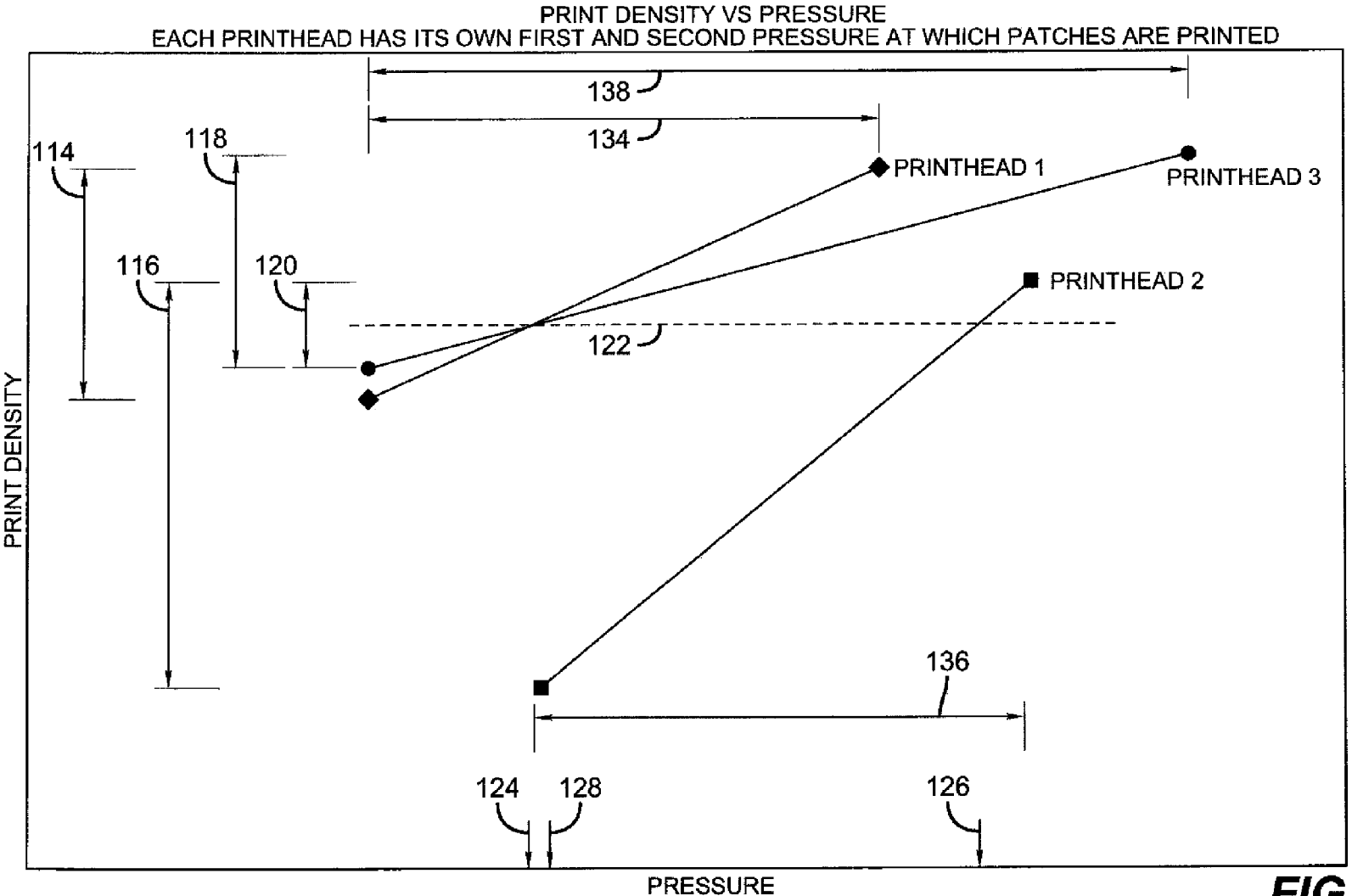
FIG. 5 is a graph of print density versus pressure for patches wherein each printhead has individual first and second pressure controls.

Referring to FIGS. 4 and 5, micro-controller 38 causes ink to be supplied to each of the plurality of printheads 30 at a first pressure by means of the pressure regulator 46 associated with each of the printheads 30. A first color patch 102 is printed on the recording medium 36 with a plurality of printheads 30 at the first pressure and with a first pixel fill coverage. The pressure regulators 46 change the pressure of the supplied ink to the printheads to a second pressure. A second color patch 104 is printed with the plurality of printheads at the second pressure with the first pixel fill coverage.

The flow rate of ink through the nozzles of the printheads depends on the pressure of the supplied ink. Increasing the ink pressure therefore increase the amount of ink colorant deposited on the recording medium 32, and therefore the optical density of the print from each of the printheads A sensor 112, located downstream of the printheads along the recording medium path, is used to measure the print density of the first and second patches 102 and 104 respectively from each of the plurality of printheads. Appropriate sensors include, but are not limited to, a spectrophotometer, a densitometer, and a CCD array. The sensor can span the width of the print region, or alternatively, a sensor that can measure the print density of only a portion of the recording medium can be moved to various positions across the width of the recording medium 32 as indicated by arrow 108 to enable it to measure the print density of the patches from each of the printheads 30.

It is important that the first and second patches printed by each printhead have the same pixel fill coverage. Pixel fill coverage refers to the fraction of pixels in the patch region on which an ink drop is printed. While any coverage level can be used, in one preferred embodiment, the pixel fill coverage is in the range of 30-45%. Patches printed at such pixel coverage levels provide the greatest sensitivity of print density to the printed drop size. Patches in this pixel fill coverage level enable the target operating pressures to be determined with greater precision than when pixel fill coverage levels outside this range are used.

The print density for each of the plurality of printheads is compared to determine appropriate ink pressures to be used for each printhead to produce the same print density for each of the plurality of printheads. FIG. 4 is a graph that illustrates an embodiment of such a comparison. The measured optical density of the patches printed at the first pixel fill coverage at the first ink pressure 130 and the second ink pressure 132 has been plotted for each of the plurality of printheads. In this example the first patches, printed at the first pressure, by each of three printheads have three different measured optical densities. At the second pressure the optical density of the second patches printed by each of the three printheads also differ. The range 114 corresponds to the range of optical densities that can be printed, at the first pixel fill coverage, by printhead 1 at operating pressures within the range from the first pressure to the second pressure. Printhead 2 has an optical density range 116; for the same pressure range, Printhead 3 has an optical density range 118. Each of the three printheads therefore is able to print with an optical density in the range 120 at some appropriately chosen pressure, for that printhead, within the range from the first pressure to the second pressure.

A target optical density value 122 is selected within the range 120. For each printhead an operating pressure is determined to yield the target optical density value. In this embodiment, a linear regression of the optical density versus the pressure is used to interpolate the print density versus pressure curve or function for each of printheads between the first and second densities. The interpolated print density versus pressure curve or function for each printhead is used to, determine the target pressure for each of the three printheads to yield the target optical density value 122. Pressures 124, 126, and 128 are the target pressures for Printheads 1-3 respectively. While linear regressions are shown, the invention is not limited to the use of linear regressions for determining the target pressure. The ink pressure for each of the plurality of printheads is adjusted to the corresponding target to compensate for differences in density for each of the printheads. In a preferred embodiment, the target pressure value for a printhead is stored in memory on the printhead.

In the embodiment shown in FIG. 4, the first color patches for each of the plurality of printheads were printed at the same first pressure. Similarly the second color patches for each of the plurality of printheads were printed at a second pressure that was the same for each of the printheads, but different from the first pressure. FIG. 5 illustrates an alternate embodiment in which the first pressure used for printing the first color patch for one of the printheads differs from the first pressure used for printing the first color patch of another of the plurality of printheads. Similarly, second pressure used for printing the second color patch for one of the plurality of printheads differs from the second pressure used for printing the second color patch of another of the plurality of printheads.

In FIG. 5, printhead 1 can operate properly of a pressure range 134. First and second print patches are printed by printhead 1 at a first pressure at the low end of the pressure range 134 and at a second pressure at the upper end of the pressure range 134, respectively. Across the pressure range 134, printhead 1 produces a print density range 114, which corresponds to the difference in the print densities of the first and second patches. Printhead 2 has an operating pressure range 136 that differs from the operating pressure range 134 of printhead 1. Printhead 2 has a pressure operating range 136 that differs from the pressure range 134 of the first printhead. First and second pressure for printhead 2 are selected from the pressure range 136, typically as each end of the pressure range, for printing the first and second patches for printhead 2. The first and second pressures used for printhead 2 differ from the first and second pressures used for printing the patches for printhead 1. The range in print density between the first and second patches of printhead 2 is 116. Printhead 3 has a operating pressure range 138 that differs significantly from the operating pressure ranges of the other two printheads. The first pressure for printhead 3 is the same as the first pressure for printhead 1. The second pressure, at the upper end of the pressure range 138, however is quite different from the second pressure of printhead 1, at the upper end of pressure range 134. The print density range of printhead 3 across the pressure range 138 corresponds to 118. Density range 120 is density range that is common to each of the printheads when they are each operated within their one pressure ranges. A density 122 is selected from common density range 120 as the target print density for each of the printheads. By interpolating between the first and second print densities printed at the first and second pressures associated with each of the printheads, a target pressure can be identified for each of the plurality of printheads. The target pressures of printheads 1-3 are 124, 126, and 128 respectively. The ink pressures for each of the printheads are adjusted to the corresponding target pressure for the printing of subsequent documents. In a preferred embodiment, the target pressure value is stored in memory that is on the printhead.

As the print density can drift as the ink dries, preferably the print density of the patches is measured after the ink has dried on the recording medium. This can be accomplished by locating the sensor 112 a sufficient distance downstream of the printheads to allow the ink to dry without assistance, or alternatively, a dryer 140 can be located between the printheads 30 and the sensor 112 to accelerate the drying of the ink on the recording medium.

Adjustment of the ink pressure for each of the printheads to the corresponding target pressure yields the desired consistency of print density between the printheads of the plurality of printheads. The print density however can potentially drift due to changes in the ink properties such as ink temperature, which can affect the ink flow rate through the printhead nozzles, and ink concentration, which can affect the darkness of the ink and also the flow rate of the ink through the nozzles. As all printheads are being supplied with ink from the same ink reservoir, such changes in ink properties affect all the printheads to the same degree. As a result, the print density doesn't drift printhead to printhead, but rather the print density of all the printheads drift together. To minimize print density shifts caused by changes in the ink temperature, one embodiment uses an ink temperature control system 142 to maintain a constant ink temperature. The ink temperature control system 142 may be incorporated into the micro-controller 38, or it may be a separate system. In an alternate embodiment, the ink pressure is adjusted by a temperature compensation system 144 to compensate for the changes in flow rate produced by changes in the ink temperature. The ink temperature compensation system 144 may be incorporated into the micro-controller 38, or it may be a separate system. The use of a common temperature compensation function for all the printheads ensures that the print density stay matched printhead to printhead.

To minimize print density shifts caused by changes in ink concentration, an ink concentration control system 146 is used Ink concentration control systems are well known in the art. The ink concentration control system 146 may be incorporated into the micro-controller 38, or it may be a separate system.

Even when printhead to printhead uniformity of print density is achieved, and ink properties are maintained or compensated for as discussed above, there remains the possibility that the print density of all of the printheads can drift. This also must be avoided.

In the process outlined above, each printhead prints color patches that are measured for print density. As the printheads are located to span the recording media, the color patches are located across the width of the recording media. In a production printing environment, it is undesirable to periodically interrupt document printing to print a set of color patches across the width of the recording media to ensure that print density does not drift with time. A different process must therefore be used to insure that the print density does not drift with time.

Figure 6:
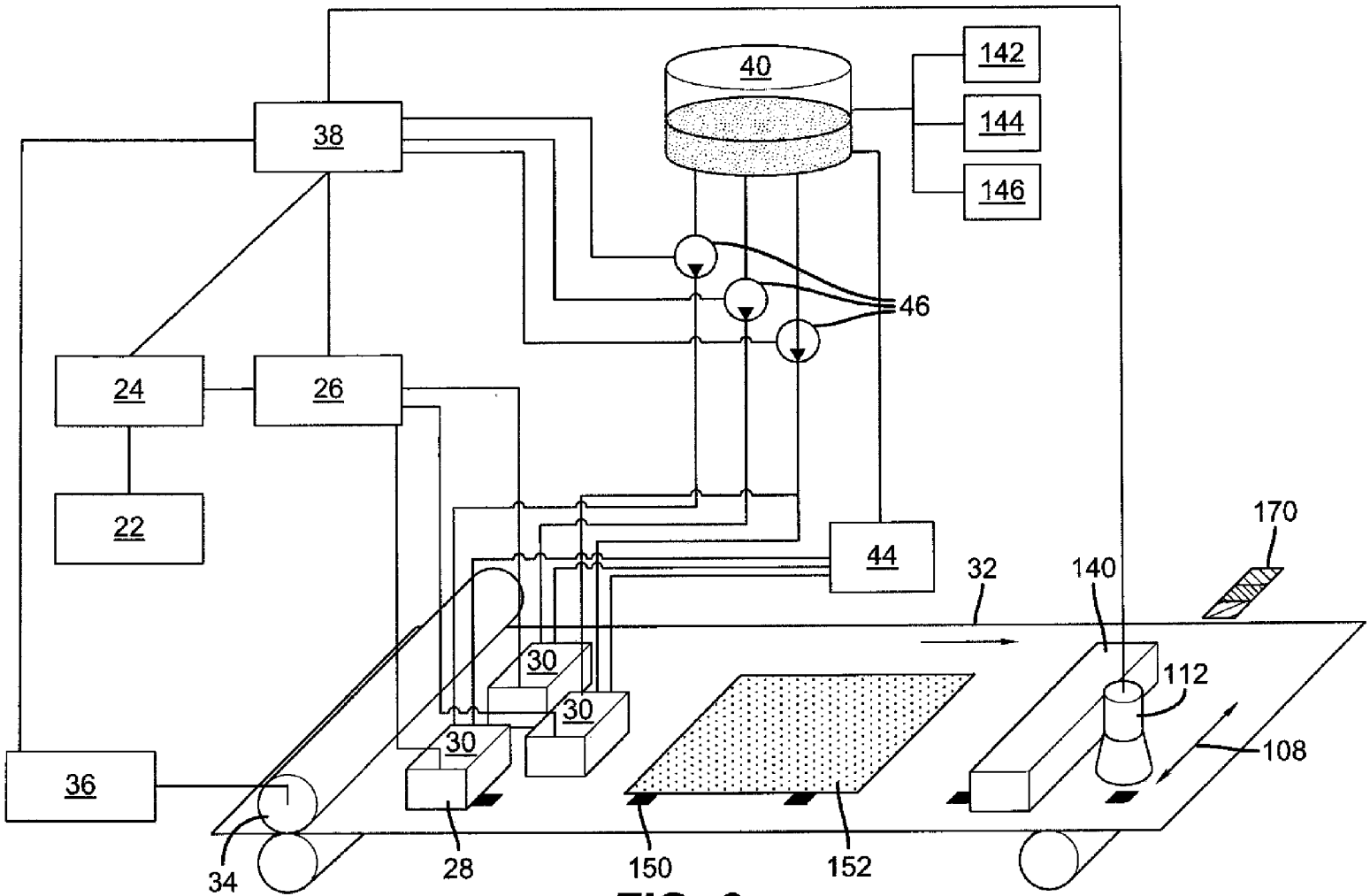
FIG. 6 shows a simplified schematic block diagram of an example embodiment of a printing system made in accordance with the present invention used for maintaining consistency of print density over time.

Rather than print color patches with each of the printheads, color patches 150 are periodically printed with just one of the printheads 30, as shown in FIG. 6. These color patches 150 are typically printed along one of the edges of the recording media 32, where they do not interfere with the printing of documents 152. The periodically printed color patches are measured for print density using the sensor 112. Typically the same sensor is used for maintaining the consistency of the print density over time as is used or maintaining the print density between the printheads. The sensor output is supplied to the micro-controller 38.

If a drift in the print density is detected, the micro-controller 38 instructs the image processing unit 24 to compensate for the drift by adjusting the algorithms used for halftoning the image. Typically the adjustment includes modifying a lookup table or transfer function used to linearize the tone scale prior to the step of halftoning the image. For example, if an increased print density is detected, the lookup table is modified to shift the mapping the input image density value to yield lower output print densities. In the context of this description, modifying the lookup table can include, changing individual table values, selecting an alternate lookup table, or combinations thereof. Modifying a transfer function can include changing function fit parameters, selecting alternative transfer functions, or combinations thereof. Processes for using a lookup table for linearizing the tone scale are well known. Processes for halftoning are well known and include the use of an ordered dither, an error diffusion algorithm, a stochastic screening process, and other suitable halftoning algorithms.

In a preferred embodiment of the invention, the color patches 150 comprise a number of patches printed at a number of well defined pixel fill factors, ranging from a pixel fill coverage of 2% up to complete coverage, 100% pixel fill coverage that are repeatedly printed. The measured print density from each of these color patches, in addition to the print density from an unprinted portion of the recording medium, a 0% pixel fill coverage, enable the lookup table to be adjusted to compensate for drifts in print density throughout the pixel fill coverage range.

While FIG. 6 shows only one group of printheads for printing a single color of printing, additional groups of printheads for printing additional colors of ink can be used. A common sensor 112 can be used for measuring the print density of color patches printed by each of the groups of printheads printing each of the colors of ink on one side of the recording medium 32. A second sensor 112 is typically used to measure the print density of color patches printed by each of the groups of printheads printing each of the colors of ink on the second side of the recording medium 32

The sensor 112 can be calibrated by means of a calibration target 170. The calibration target 170 typically is located on a printer frame (not shown) to the side of the path of the recording medium 32. The sensor 112 can be translated over to the calibration target where it measures the print density of one or more print density standard patches. This calibration can take place at startup, at a periodic basis, or as requested by the operator.

The invention has been described in detail with particular reference to certain preferred embodiments thereof, but it will be understood that variations and modifications can be effected within the scope of the invention. For example, the invention has been described for use in a continuous inkjet printer system that employs a gas flow drop deflection mechanism, thermal drop stimulation devices, and nozzle plates fabricated out of silicon. However, the invention can also be employed in continuous inkjet printer systems that use electrostatic drop deflection mechanisms, pressure modulation or vibrating body stimulation devices, and nozzles plates fabricated out of other types of materials.

Electrostatic deflection can be of the type that includes separate drop charging and drop deflection electrodes or can be of the type that incorporates both functions in a single electrode.

PARTS LIST

20 continuous printer system
22 image source
24 image processing unit
26 mechanism control circuits
28 device
30 printhead
32 recording medium
34 recording medium transport system
36 recording medium transport control system
38 micro-controller
40 reservoir
42 catcher
44 recycling unit
46 pressure regulator
47 channel
48 jetting module
49 nozzle plate
50 plurality of nozzles
51 heater
52 liquid

54 drops
56 drops
57 trajectory
58 drop stream
60 gas flow deflection mechanism
61 positive pressure gas flow structure
62 gas flow
63 negative pressure gas flow structure
64 deflection zone
66 small drop trajectory
68 large drop trajectory
72 first gas flow duct
74 lower wall
76 upper wall
78 second gas flow duct
82 upper wall
84 seal
86 liquid return duct
88 plate
90 front face
92 positive pressure source
94 negative pressure source
96 wall
102 color patch
104 color patch
108 arrow
112 sensor
114 range
116 range
118 range
120 range
122 target density
124 target pressure
126 target pressure
128 target pressure
130 first pressure
132 second pressure
134 first pressure range
136 second pressure range
138 third pressure range
140 dryer
142 temperature control system
144 temperature compensation system
146 ink concentration control system
150 patches
152 document
170 calibration target

The invention claimed is:

1. An apparatus for insuring color consistency for a multi-printhead system comprising:

a plurality of printheads for printing a first color patch having a first pixel fill coverage with an ink supplied to the printhead at a first pressure;

wherein each printhead prints a second color having a first pixel fill coverage with the ink supplied to the plurality of printheads at a second pressure;

a sensor for measuring a print density of the first patch and the second patch for each of the plurality of printheads;

a processor for comparing the print density of the first patch and the second patch printed by each of the plurality of printheads; and wherein the supplied pressure is adjusted for each of the plurality of printheads to compensate for differences in density between the first patch and the second patch for each of the printheads.

2. The apparatus of claim 1 wherein the densities are measured by a spectrometer.

3. The apparatus of claim 1 wherein:

a pressure curve for each printheads is produced by interpolating between the first densities and the second densities.

4. The apparatus of claim 1 wherein the same pressure is supplied to each of the printheads as the first pressure.

5. The apparatus of claim 1 wherein the densities are measured after drying.

6. The apparatus of claim 1 wherein the sensor is a densitometer.

7. The apparatus of claim 1 wherein each of the plurality of printheads are supplied with ink from a common reservoir.

8. The apparatus of claim 1 wherein the pressure selected for each of the plurality of printheads is stored in memory in the corresponding printhead.

9. The apparatus of claim 1 wherein operating pressure for each printhead has a temperature compensation function and the temperature compensation function is the same for each of the plurality of printheads.

10. The apparatus of claim 1 wherein each of the plurality of printheads has the same base drop formation frequency.

11. The apparatus of claim 1 wherein print density for each of the printheads is measured by the same sensor.

12. The apparatus of claim 1 further comprising continued monitoring of the print density of one of the plurality of printheads.

13. The apparatus of claim 12 further comprising adjusting halftoning of data sent to each of the plurality of printheads to compensate for changes in print density detected by monitoring of print density of the one of the plurality of printheads.

14. The apparatus of claim 1 wherein the first pixel fill coverage is in the range of 30-45%.

* * * * *